United States Patent [19]

Gibson

[11] Patent Number: 4,810,032

[45] Date of Patent: Mar. 7, 1989

[54] STABILIZED SPRING HOLDER

[76] Inventor: John Gibson, P.O. Box 535, Dallas, N.C. 28034

[21] Appl. No.: 192,148

[22] Filed: May 10, 1988

[51] Int. Cl.[4] ..... A47C 3/02

[52] U.S. Cl. ..... 297/265; 297/261

[58] Field of Search ..... 297/261, 264, 265, 267, 297/268, 269, 332, 333, 292, 293, 262, 301, 302, 305; 267/91, 103, 80, 177; 248/576, 577, 578, 605, 624

[56] References Cited

U.S. PATENT DOCUMENTS 2,772,723 12/1956 Tunnell ..... 297/267

3,603,640 9/1971 Doerner ..... 297/292

3,966,251 6/1976 Belisle ..... 297/261 X 4,549,859 10/1985 Androine ..... 267/179 X

*Primary Examiner*—James T. McCall

*Attorney, Agent, or Firm*—Clifton Ted Hunt

[57] ABSTRACT

An increased bearing surface is provided on spring holders for coil springs used in a platform rocking chair between the wooden chair rocker and the platform. The increased bearing surface protects the chair structure against damage to the wood and loosening of the attachment of the spring holders to the chair structure heretofore caused by the reciprocating lateral forces generated by the rocking motion of the chair.

13 Claims, 2 Drawing Sheets

STABILIZED SPRING HOLDER

FIELD OF THE INVENTION

This invention relates to platform rocking chairs, and more specifically to an improved spring holder for stabilizing the connection of the chair to its platform.

BACKGROUND OF THE INVENTION

U.S. Pat. No. 2,772,723 issued Dec. 4, 1956 to Jack B. Tunnell for SPRING UNIT FOR PLATFORM ROCKING CHAIR discloses the spring holder with which this invention is specifically concerned. The spring holder of this invention is called a mounting bracket in the Tunnell patent. The mounting brackets in the spring unit described in the Tunnell patent were specifically designed to withstand the stress imposed by resistance of opposed coil springs to elongation upon rocking movement of the chair.

The mounting brackets in the Tunnell spring unit successfully withstand the forces imposed on the spring unit by the rocking motion of the chair, but difficulty has been encountered in stabilizing the connection of the Tunnell spring units to the chair and to the platform. The force exerted by the vertically reciprocating rocking motion of the chair imparts laterally reciprocating motion to the Tunnell mounting brackets, and to the spring holders of this invention. The lateral motion is forceful and causes the sharp ends of the prior art mounting bracket to gradually wear away the wood at the points of attachment and loosen the connection of the steel mounting brackets to the wooden base and wooden platform.

The prior art mounting bracket has edge flanges at each end which extend laterally and terminate in sharp ends flush with the attachment face of the mounting flange. When operatively installed on a platform rocking chair the sharp ends of the edge flanges bear against the wooden chair or the wooden platform. It is the sharp ends of these edge flanges that dig into and wear away the wood.

SUMMARY OF THE INVENTION

According to the invention, the attachment of the spring holders to the wood chair and the wood platform is stabilized by increasing the surface area of those portions of the spring holder that contact the wood chair or the wood platform.

In the illustrated embodiments of the invention, the surface area is increased by adding bearing flanges or feet that extend perpendicularly from their respective edge flanges on the spring holder of this invention. The bearing flanges extend in substantially the same plane as the attachment face of the mounting flange on the spring holder. The bearing flanges bear against the wooden chair or the wooden platform when the platform rocking chair is operatively assembled and the increased surface area at the points of contact prevents the spring holders from digging into and eating away the wood, thereby stabilizing the attachment of the spring holders to the wooden chair and platform.

DETAILED DESCRIPTION OF THE INVENTION

Referring more specifically to the drawings, the numeral 10 broadly indicates the prior art mounting bracket disclosed and claimed in U.S. Pat. No. 2,772,723 issued Dec. 4, 1956 to Jack B. Tunnell for SPRING UNIT FOR PLATFORM ROCKING CHAIR.

Figure 1:
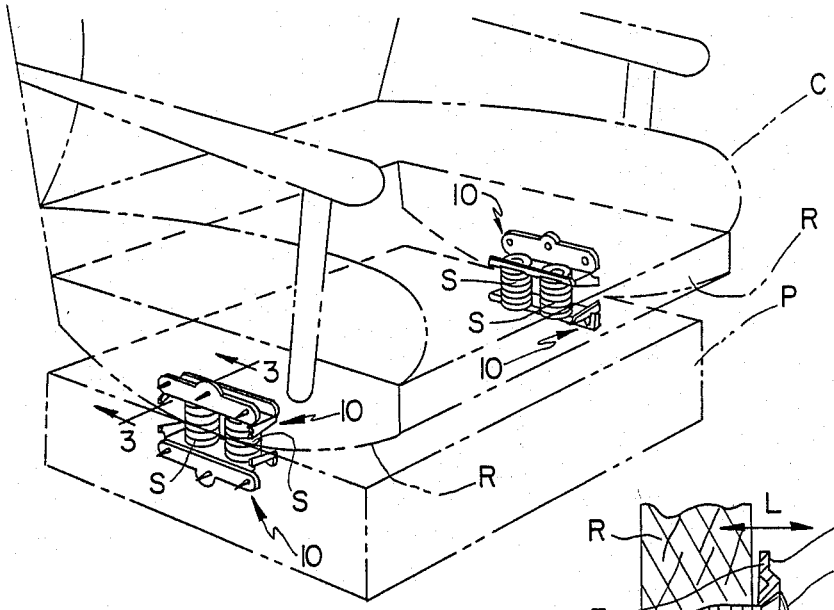
Fig. 1 PRIOR ART
FIG. 1 is an environmental perspective view showing a prior art platform rocking chair in phantom lines and showing the prior art mounting brackets in solid lines connecting the chair to the platform.

A pair of mounting brackets 10 is mounted on each side of a platform rocking chair comprising a chair C and a platform P as shown in FIG. 1. One mounting bracket 10 is fastened to the wooden rocker R on each side of the chair C and one mounting bracket 10 is fastened to each side of the wooden platform P. A pair of coil springs S extend between the mounting brackets 10 on each side of the platform rocking chair in a known manner as explained, for example, in the Tunnell patent.

Figure 3:
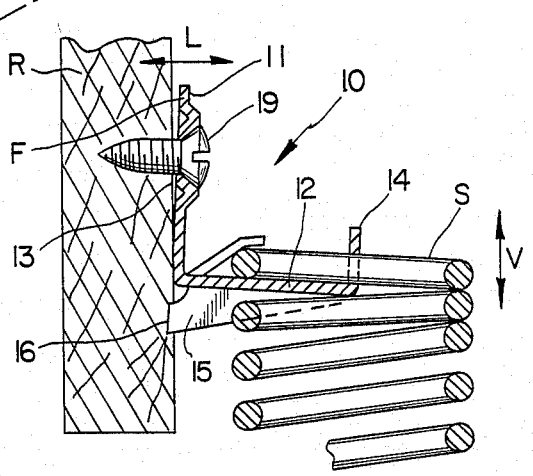
Fig. 3 PRIOR ART
FIG. 3 is an enlarged sectional view taken substantially along the line 3—3 in FIG. 1 and illustrating the forceful and destructive reciprocating lateral force generated against the wooden chair and the wooden platform by the rocking motion of the chair.
Figure 2:
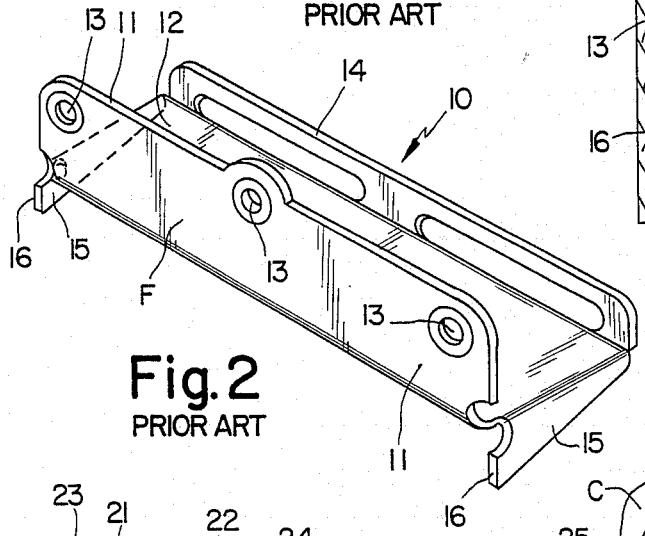
Fig. 2 PRIOR ART
FIG. 2 is an enlarged perspective view of one of the prior art mounting brackets shown in FIG. 1.

FIG. 2 shows the mounting bracket 10 removed from the platform rocking chair. The mounting bracket 10 includes a mounting flange 11 and a spring support flange 12 extending in perpendicular relation to each other as best seen in FIG. 3. The mounting flange 11 has a plurality of screw receiving apertures 13 for attachment of the mounting bracket 10 to either the rocker R or the wooden platform P of the platform rocking chair shown in FIG. 1. A slotted spring locking flange 14 extends in parallel relation to the mounting flange 11 along the edge of the spring support flange 12 opposite the mounting flange 11.

The spaced disposition of the coil springs S tends to maintain the chair C at rest and the spacing of the springs also causes spring reaction in opposition to any rocking movement of the chair C. The spring reaction occurs by resistance to elongation of the forwardly or the rearwardly disposed springs S upon rocking movement of the chair C, and this reaction is transmitted through the mounting brackets 10 in a manner that imposes severe flexure stresses at the juncture between the mounting flange 11 and the spring support flange 12.

FIG. 3 illustrates how the offset relation of the mounting flange 11 and the coil springs S, which are centered on the spring support flange 12 and laterally spaced from the mounting flange 11, also imposes severe flexural stresses on the attachment of the mounting flanges 11 to the wooden rocker R and to the platform P. Reciprocating vertical movement of the springs S in the direction of the arrow V in FIG. 3 is caused by the rocking of the chair C, and the offset relation of the springs S with the mounting flange 11 causes corresponding reciprocating lateral movement of the mounting flange 11 relative to the wooden chair structure as indicated by the arrow L in FIG. 3.

The Tunnell patent explains that the prior art mounting bracket 10 is advantageously provided with edge flanges 15 which terminate as at 16 (in FIG. 2 of this application) in substantially flush relation with the attachment face F of the mounting flange 11 for further strengthening and adequately securing the mounting bracket 10 in the chair structure.

The edge flanges 15 do strengthen the structure and the ends 16 of the flanges 15 do initially serve a purpose in adequately securing the mounting brackets 10 in the chair structure by bearing against the chair structure and providing stability to the attachment. Over a period of time, however, the reciprocating lateral force of the mounting flange 11 against the chair structure causes the sharp end 16 to dig into the wood and wear it away. The screw attachment of the prior art mounting bracket 10 to the chair structure by screws 19 gradually becomes loosened, as indicated in FIG. 3.

Figure 4:
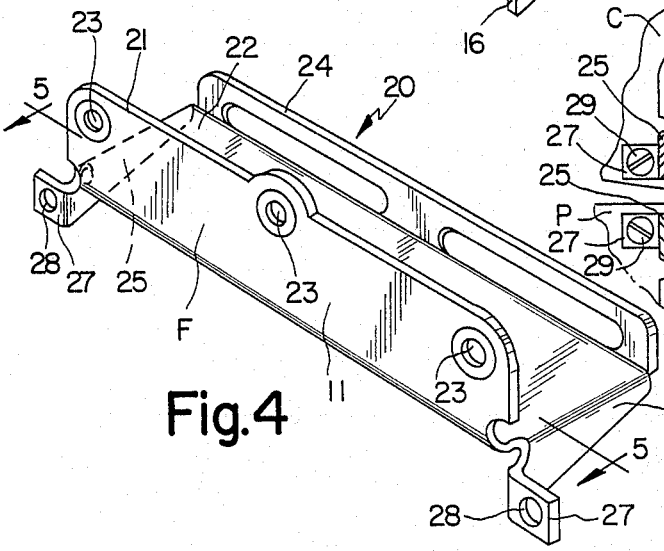
FIG. 4 is a perspective view of one embodiment of the spring holder of this invention.
Figure 5:
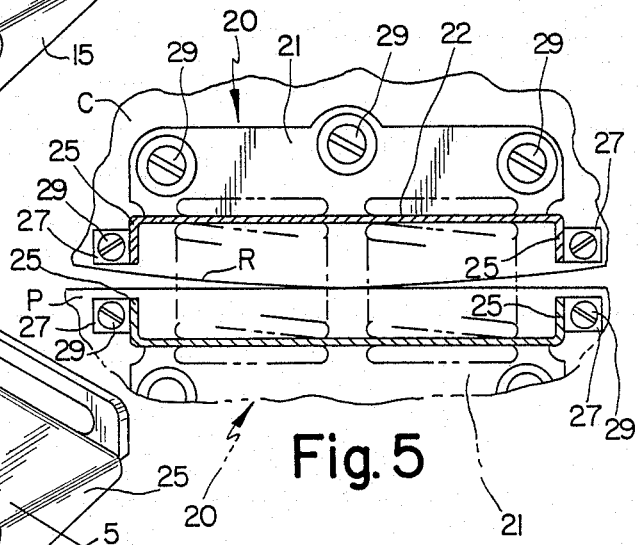
FIG. 5 is a sectional view taken substantially along the line 5—5 in FIG. 4 and illustrating the stabilized attachment of the spring holders to the chair rocker and to the platform.

Referring to FIGS. 4 and 5, the improved spring holder is generally indicated at 20. The structure of the spring holder 20 generally corresponds to the structure of the prior art mounting bracket 10, and like parts of the spring holder 20 are indicated by the same reference number plus 10. For example, the spring holder 20 has a mounting flange 21 and a spring support flange 22 corresponding to the mounting flange 11 and the spring support flange 12 on the prior art mounting bracket 10.

The spring holder 20 differs from the prior art mounting bracket 10 by replacing the sharp ends 16 on the edge flanges 15 of the mounting bracket 10 with bearing flanges or feet 27. The flanges or feet 27 extend laterally from the edge flanges 25 of spring support 20 in the same plane as the attachment face F of the mounting flange 21 and, with the mounting flange 21, bear against the wooden chair structure when the spring supports are operatively mounted. The bearing flanges 27 increase the surface area that bears against the chair structure, and the increased bearing surface protects the chair structure against the damage heretofore caused by the reciprocating lateral movement generated by the rocking motion of the chair.

In the embodiment of the invention illustrated in FIGS. 4 and 5, the bearing flanges or feet 27 extend outwardly beyond the edge flanges 25. The bearing flanges 27 have apertures 28 to receive screws 29 for attachment to the wooden chair structure to more completely stabilize the attachment of the spring holders 20 to the chair structure.

Figure 6:
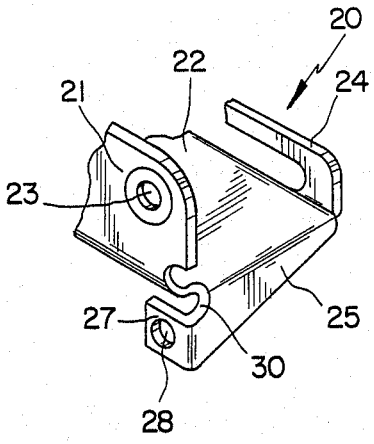
FIGS. 6, 7, 8, and 9 are fragmentary perspective views, with parts broken away, illustrating alternative embodiments of the invention.

FIGS. 6–10 illustrate different configurations of the bearing flanges or feet 27. In FIG. 6, the feet 27 extend inwardly toward each other from the edge flanges 25 and may be spaced apart any desired distance, or may extend the entire distance between the edge flanges 25.

Figure 7:
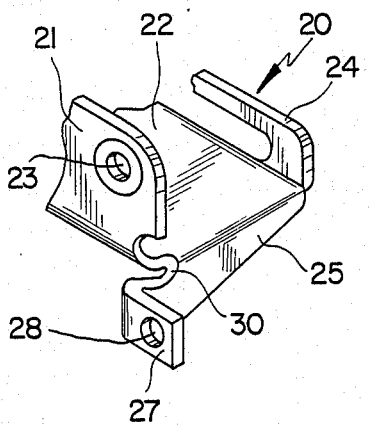

In FIG. 7, the feet 27 are connected by angular junctures 30 to the edge flanges 25. Portions of each foot 27 are thus positioned between the edge flanges 25, directly beneath its edge flange 25, and laterally beyond its edge flange 25. Such an arrangement places portions of the feet 27 directly in line with the reciprocating lateral force generated by the rocking of the chair and effectively broadens the support base for the edge flanges to provide increased stability.

Figure 8:
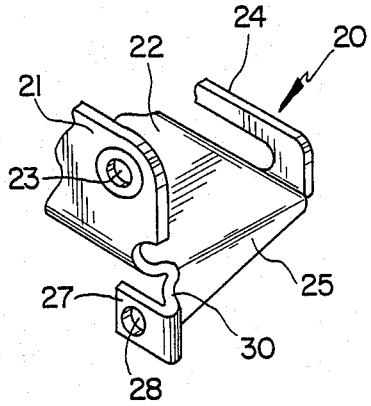

FIG. 8 illustrates the use of the angular juncture 30 to get the benefit of positioning portions of the feet 27 directly beneath corresponding edge flanges 25 with the free ends of the feet 27 extending outwardly beyond their respective edge flanges 25 instead of inwardly therefrom as shown in FIG. 7.

Figure 9:
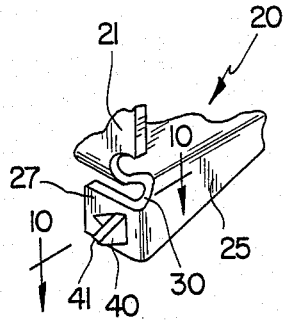
Figure 10:
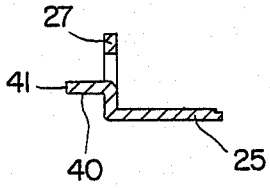
FIG. 10 a sectional view taken substantially along the line 10—10 in FIG. 9.

FIGS. 9 and 10 show an anchor tab 40 formed integrally with one of the feet 27, it being understood that a corresponding anchor tab is formed integrally with the foot on the other end of the spring holder 20 in FIG. 9. The tabs 40 replace the apertures 28 in the earlier described embodiments.

The tabs 40 are of triangular configuration and may be struck from the metal when the spring holder is manufactured as by a stamping operation. The pointed ends 41 of the tabs extend outwardly from the common plane of the attachment face F and feet 27 and are forced into the wooden chair structure when the spring holders are mounted on the chair structure. The lateral force generated by rocking the chair keeps the tabs embedded in the wood to add stability to the attachment.

There is thus provided an improved spring holder which protects the wooden chair structure of a platform rocking chair against deterioration and correspondingly prolongs the life of the chair.

Although specific terms have been used in describing the invention, they are used in a descriptive and generic sense only and not for the purpose of limitation.

I claim:

1. In a spring holder having a mounting flange including an attachment face for attachment of the spring holder to the wooden chair structure of a platform rocking chair and having a spring support flange and an edge flange at each end of the spring support flange, the combination of at least one bearing flange extending perpendicularly from the edge flanges and extending in the same plane as the attachment face of the mounting flange, whereby the bearing flanges increase the surface area of the spring holder bearing against the wooden chair structure when the platform rocking chair is operatively assembled and protect the wooden chair structure from deterioration by the laterally reciprocating force generated by rocking of the chair.

2. A spring holder according to claim 1 wherein a bearing flange extends from each edge flange.

3. A spring holder according to claim 2 wherein the bearing flanges extend outwardly beyond the ends of the spring holder.

4. A spring holder according to claim 2 wherein the bearing flanges extend inwardly toward each other from their respective edge flanges.

5. A spring holder according to claim 2 wherein means are provided between each edge flange and its respective bearing flange to position portions of the bearing flanges in direct line with their respective edge flanges.

6. A spring holder according to claim 2 wherein each bearing flange has an aperture to receive a screw for attachment to the chair structure.

7. A spring holder according to claim 2 wherein an anchor tab extends from each bearing flange toward the chair structure when the spring holder is operatively assembled to the chair structure, whereby the anchor tabs become embedded in the chair structure and stabilize the attachment of the spring holder to the chair structure.

8. A spring holder for use in a spring unit to attach coil springs to the chair structure of a platform rocking chair, said spring holder comprising:

(a) a spring support flange for supporting corresponding ends of the coil springs, (b) a spring locking flange extending along one edge of the spring support flange, (c) a a mounting flange extending along the edge of the spring support flange opposite said one edge, (d) the spring locking flange and the mounting flange extending perpendicularly to the spring support flange and in parallel relation to each other, (e) an edge flange extending from each end of the spring support flange in the opposite direction from the spring locking flange and the mounting flange, (f) corresponding ends of the edge flanges terminating at the plane of the mounting flange and, (g) a bearing flange extending from each edge flange in the plane of the mounting flange.

9. A spring support according to claim 8 wherein the bearing flanges extend inwardly toward each other from their respective edge flanges.

10. A spring support according to claim 8 wherein the bearing flanges extend outwardly away from each other from their respective edge flanges.

11. A spring support according to claim 8 wherein means are provided between each edge flange and its respective bearing flange to position portions of the bearing flanges in direct line with their respective edge flanges.

12. A spring holder according to claim 8 wherein each bearing flange has an aperture to receive a screw for attachment to the chair structure.

13. A spring holder according to claim 8 wherein an anchor tab extends from each bearing flange toward the chair structure when the spring holder is operatively assembled to the chair structure, whereby the anchor tabs become embedded in the chair structure and stabilize the attachment of the spring holder to the chair structure.

* * * * *